US010978795B2

(12) United States Patent
Chen et al.

(10) Patent No.: US 10,978,795 B2
(45) Date of Patent: Apr. 13, 2021

(54) ANTENNA STRUCTURE AND WIRELESS COMMUNICATION DEVICE USING THE SAME

(71) Applicant: Chiun Mai Communication Systems, Inc., New Taipei (TW)

(72) Inventors: Chang-Je Chen, New Taipei (TW); Shu-Wei Jhang, New Taipei (TW); Tun-Yuan Tsou, New Taipei (TW); Yi-Te Chou, New Taipei (TW); Yung-Chin Chen, New Taipei (TW); Chang-Ching Huang, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 351 days.

(21) Appl. No.: 16/234,410

(22) Filed: Dec. 27, 2018

(65) Prior Publication Data

US 2019/0214714 A1 Jul. 11, 2019

(30) Foreign Application Priority Data

Dec. 27, 2017 (CN) ..... 201711448309.7

(51) Int. Cl.
*H01Q 1/36* (2006.01)
*H01Q 1/24* (2006.01)
(Continued)

(52) U.S. Cl.
CPC ..... *H01Q 1/36* (2013.01); *H01Q 1/243* (2013.01); *H01Q 1/44* (2013.01); *H01Q 5/307* (2015.01);
(Continued)

(58) Field of Classification Search
CPC ..... H01Q 1/243; H01Q 1/44; H01Q 5/307; H01Q 5/40; H01Q 5/378; H01Q 5/371; H01Q 5/335; H01Q 9/42; H01Q 21/28
See application file for complete search history.

(56) References Cited

U.S. PATENT DOCUMENTS 9,559,433 B2 * 1/2017 Zhou ..... H01Q 5/35
9,912,049 B2 * 3/2018 Chang ..... H01Q 1/48
(Continued)

FOREIGN PATENT DOCUMENTS

CN 105789831 A 7/2016
CN 105826653 A 8/2016
(Continued)

*Primary Examiner* — Ab Salam Alkassim, Jr.
(74) *Attorney, Agent, or Firm* — ScienBiziP, P.C.

(57) ABSTRACT

An antenna structure includes a housing, a feed portion, a ground portion, a first radiator, and a second radiator. The housing includes a first radiating portion and a second radiating portion. The first radiator and the second radiator are both positioned in the housing. When the feed portion feeds current, the current flows through the first radiating portion and is grounded through the ground portion to activate a first operating mode. When the feed portion feeds current, the current is further coupled to the first radiator through the first radiating portion, and the first radiator activates a second operating mode. When the second radiator feeds current, the second radiator activates a third operating mode. When the second radiator feeds current, the current is further coupled to the second radiating portion through the second radiator, and the second radiating portion activates a fourth operating mode.

17 Claims, 8 Drawing Sheets

(51) Int. Cl.

| | |
|---|---|
| ***H01Q 5/371*** | (2015.01) |
| ***H01Q 5/335*** | (2015.01) |
| ***H01Q 21/28*** | (2006.01) |
| ***H01Q 9/42*** | (2006.01) |
| ***H01Q 5/40*** | (2015.01) |
| ***H01Q 5/378*** | (2015.01) |
| ***H01Q 1/44*** | (2006.01) |
| ***H01Q 5/307*** | (2015.01) |

(52) U.S. Cl.

CPC ..... *H01Q 5/335* (2015.01); *H01Q 5/371* (2015.01); *H01Q 5/378* (2015.01); *H01Q 5/40* (2015.01); *H01Q 9/42* (2013.01); *H01Q 21/28* (2013.01)

(56) References Cited

U.S. PATENT DOCUMENTS 10,396,837 B2* 8/2019 Shin ..... H04B 1/006
10,461,425 B2* 10/2019 Liou ..... H01Q 21/28
10,511,081 B2* 12/2019 Chen ..... H04M 1/026
10,559,871 B2* 2/2020 Chen ..... H01Q 9/40
10,629,983 B2* 4/2020 Zhang ..... H01Q 21/28
10,700,416 B2* 6/2020 Jung ..... H01Q 13/10
2012/0229347 A1* 9/2012 Jin ..... H01Q 1/44 343/702
2013/0135157 A1* 5/2013 Tsou ..... H01Q 1/52 343/702
2014/0266923 A1* 9/2014 Zhou ..... H01Q 1/243 343/702
2014/0292590 A1* 10/2014 Yoo ..... H01Q 1/243 343/702
2015/0022403 A1* 1/2015 Lin ..... H01Q 1/44 343/702
2015/0188212 A1* 7/2015 Tseng ..... H01Q 21/28 343/702
2015/0349404 A1* 12/2015 Wang ..... H01Q 5/314 343/702
2016/0064820 A1* 3/2016 Kim ..... H01Q 9/0421 343/767
2016/0164169 A1* 6/2016 Krogerus ..... H01Q 21/28 343/702
2017/0047641 A1* 2/2017 Kim ..... H01Q 5/364
2017/0155186 A1* 6/2017 Lin ..... H01Q 1/243
2017/0222304 A1* 8/2017 Xue ..... H01Q 1/243
2017/0338545 A1* 11/2017 Guo ..... H01Q 1/243
2017/0346159 A1* 11/2017 Xue ..... H01Q 5/314
2018/0026332 A1* 1/2018 Lin ..... H01Q 1/48 343/872
2018/0026334 A1* 1/2018 Chen ..... H01Q 9/42 343/702
2018/0026336 A1* 1/2018 Chen ..... H04Q 1/48 343/702
2018/0026337 A1* 1/2018 Chen ..... H01Q 5/378 343/702
2018/0026338 A1* 1/2018 Lin ..... H01Q 5/35 343/702
2018/0026339 A1* 1/2018 Chih ..... H01Q 5/378 343/702
2018/0026347 A1* 1/2018 Lee ..... H01Q 5/371 455/575.7
2018/0026348 A1* 1/2018 Lee ..... H01Q 1/44 455/575.5
2018/0026350 A1* 1/2018 Hung ..... H01Q 1/243 455/575.7
2018/0026353 A1* 1/2018 Tseng ..... H01Q 13/10 455/575.7
2018/0026354 A1* 1/2018 Lin ..... H04M 1/026 343/702
2018/0026360 A1* 1/2018 Lee ..... H01Q 5/371 343/872
2018/0062244 A1* 3/2018 Huang ..... H01Q 1/243
2018/0233807 A1* 8/2018 Ma ..... H01Q 1/521
2018/0248250 A1* 8/2018 Hsu ..... H04M 1/0283
2018/0248264 A1* 8/2018 Chen ..... H01Q 9/40
2019/0036210 A1* 1/2019 Kim ..... G06F 1/203
2019/0044218 A1* 2/2019 Ye ..... H01Q 5/385
2019/0115653 A1* 4/2019 Yun ..... H01Q 13/10
2019/0131694 A1* 5/2019 Lee ..... H01Q 1/243
2019/0181553 A1* 6/2019 Lee ..... H01Q 13/10
2019/0181555 A1* 6/2019 Lee ..... H01Q 5/35
2019/0198975 A1* 6/2019 Chen ..... H01Q 1/48
2019/0252764 A1* 8/2019 Liao ..... H01Q 5/328
2019/0393586 A1* 12/2019 Ayala Vazquez ..... H01Q 9/42
2020/0007184 A1* 1/2020 Jung ..... H04B 1/525
2020/0058981 A1* 2/2020 Chang ..... H01Q 5/30
2020/0076056 A1* 3/2020 Froese ..... H01Q 1/42
2020/0076057 A1* 3/2020 Leutheuser ..... H05K 5/0004
2020/0076059 A1* 3/2020 Hsiao ..... H01Q 9/42
2020/0358198 A1* 11/2020 Hsu ..... H01Q 1/44

FOREIGN PATENT DOCUMENTS

CN 105932408 A 9/2016
CN 205583123 U 9/2016

* cited by examiner

ANTENNA STRUCTURE AND WIRELESS COMMUNICATION DEVICE USING THE SAME

FIELD

The subject matter herein generally relates to an antenna structure and a wireless communication device using the antenna structure.

BACKGROUND

Antennas are important components in wireless communication devices for receiving and transmitting wireless signals at different frequencies, such as signals in Long Term Evolution Advanced (LTE-A) frequency bands. However, the antenna structure is complicated and occupies a large space in the wireless communication device, which is inconvenient for miniaturization of the wireless communication device.

Therefore, there is room for improvement within the art.

BRIEF DESCRIPTION OF THE DRAWINGS

Implementations of the present disclosure will now be described, by way of example only, with reference to the attached figures.

DETAILED DESCRIPTION

Figure 1:
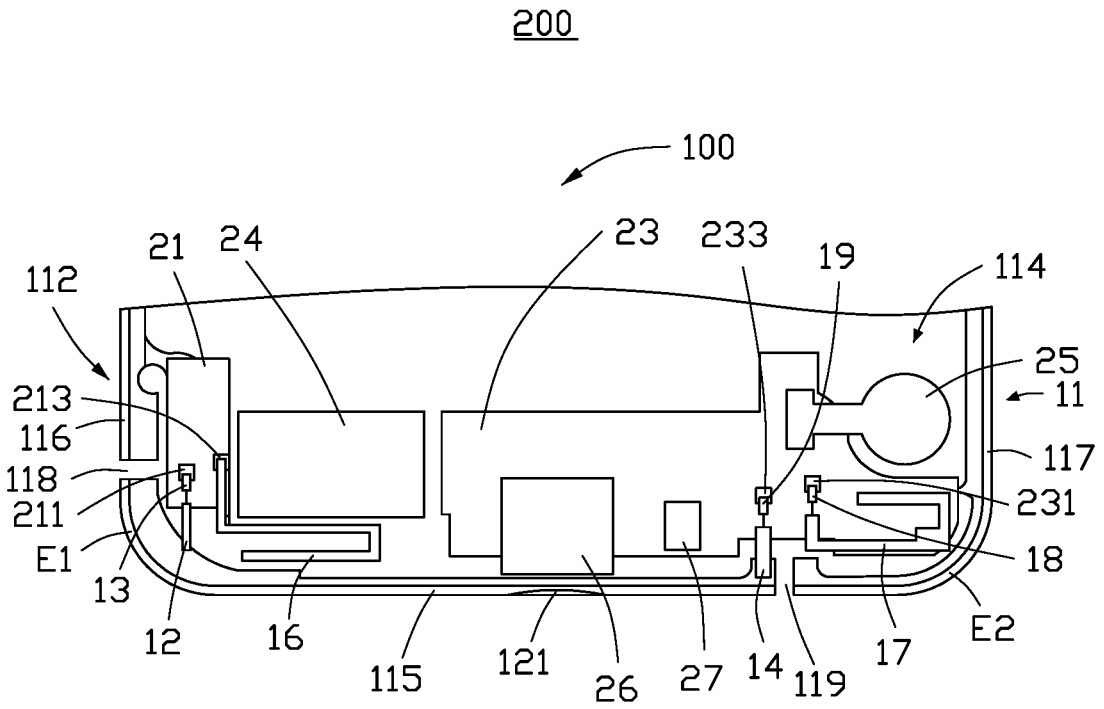
FIG. 1 is an isometric view of an embodiment of a wireless communication device using an antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like.

The present disclosure is described in relation to an antenna structure and a wireless communication device using same.

FIG. 1 illustrates an embodiment of a wireless communication device 200 using an antenna structure 100. The wireless communication device 200 can be, for example, a mobile phone or a personal digital assistant. The antenna structure 100 can receive and transmit wireless signals.

The wireless communication device 200 further includes a first substrate 21 and a second substrate 23. In this embodiment, the first substrate 21 and the second substrate 23 are both made of dielectric material, for example, epoxy resin glass fiber (FR4) or the like. The first substrate 21 includes a first feed point 211 and a first ground point 213. The first feed point 211 is spaced apart from the first ground point 213. The first feed point 211 is configured to supply current to the antenna structure 100. The first ground point 213 is configured for grounding the antenna structure 100.

The second substrate 23 is spaced apart from the first substrate 21. The second substrate 23 includes a second feed point 231 and a second ground point 233. The second feed point 231 is spaced apart from the second ground point 233. The second feed point 231 is configured to supply current to the antenna structure 100. The second ground point 233 is configured for grounding the antenna structure 100.

In this embodiment, the wireless communication device 200 further includes at least four electronic elements, for example, a first electronic element 24, a second electronic element 25, a third electronic element 26, and a fourth electronic element 27.

The first electronic element 24 is a speaker. The first electronic element 24 is positioned between the first substrate 21 and the second substrate 23 adjacent to the first ground point 213. The second electronic element 25 is a vibrator. The second electronic element 25 is positioned at one side of the second substrate 23 away from the first substrate 21 adjacent to the second feed point 231.

The third electronic element 26 is spaced apart from the fourth electronic element 27. The third electronic element 26 and the fourth electronic element 27 are positioned between the first electronic element 24 and the second electronic element 25. The third electronic element 26 can be, for example, a Universal Serial Bus (USB) module. The third electronic element 26 is positioned adjacent to the first electronic element 24. The fourth electronic element 27 can be, for example, a microphone. The fourth electronic element 27 is positioned adjacent to the second ground point 233.

Figure 2:
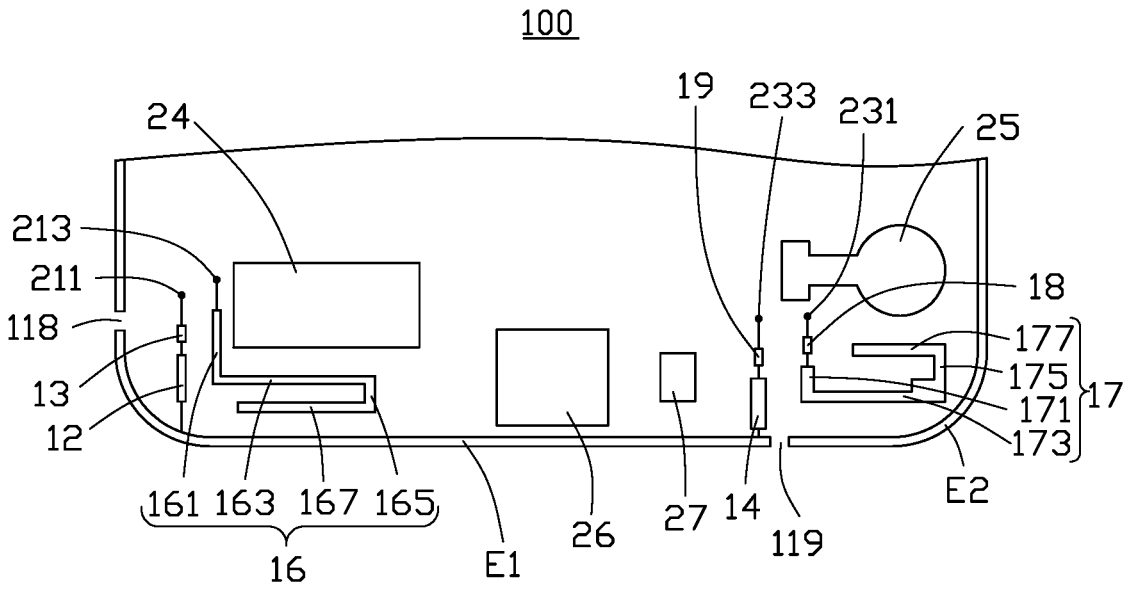
FIG. 2 is a circuit diagram of the antenna structure of FIG. 1.

In FIG. 2, the antenna structure 100 includes a housing 11, a feed portion 12, a ground portion 14, a first radiator 16, and a second radiator 17.

The housing 11 houses the wireless communication device 200. The housing 11 includes a side frame 112. In this embodiment, the side frame 112 is made of metallic material. The side frame 112 is substantially annular. The housing 11 further includes a backboard (not shown). The backboard is positioned on the side frame 112. The backboard and the side frame 112 cooperatively form a receiving space 114. The receiving space 114 can receive the first substrate 21, the second substrate 23, a processing unit, or other electronic components or modules.

The side frame 112 includes an end portion 115, a first side portion 116, and a second side portion 117. In this embodiment, the end portion 115 is a bottom portion of the wireless communication device 200. The first side portion 116 is spaced apart from and parallel to the second side portion 117. The end portion 115 has first and second ends. The first side portion 116 is connected to the first end of the end portion 115 and the second side portion 117 is connected to the second end of the end portion 115.

The side frame 112 further defines a gap 118 and a groove 119. In this embodiment, the gap 118 is defined in the first side portion 116 adjacent to the end portion 115. The groove 119 is defined in the end portion 115 adjacent to the second side portion 117. The gap 118 and the groove 119 both pass through and extend to cut across the side frame 112. The side frame 112 is divided into two portions by the gap 118 and the groove 119. The two portions are a first radiating portion E1 and a second radiating portion E2 spaced apart from the first radiating portion E1.

A portion of the side frame 112 between the gap 118 and the groove 119 forms the first radiating portion E1. A portion of the side frame 112 extending from a side of the groove 119 away from the first radiating portion E1 and the gap 118 forms the second radiating portion E2. In this embodiment, the second radiating portion E2 is grounded.

In this embodiment, the side frame 112 further defines a through hole 121. The through hole 121 is defined at the first radiating portion E1 and passes through the first radiating portion E1. The through hole 121 corresponds to the third electronic element 26. Then, the third electronic element 26 is partially exposed from the through hole 121. A USB device can be inserted into the through hole 121 and be electrically connected to the third electronic element 26.

In this embodiment, the gap 118 and the groove 119 are both filled with insulating material, for example, plastic, rubber, glass, wood, ceramic, or the like.

In this embodiment, the feed portion 12 is positioned in the housing 11 between the first electronic element 24 and the first side portion 116. One end of the feed portion 12 is electrically connected to a location of the first radiating portion E1 adjacent to the gap 118. Another end of the feed portion 12 is electrically connected to the first feed point 211 through a matching circuit 13 for feeding current to the first radiating portion E1. The matching circuit 13 may be a capacitor, an inductor, or a combination. The matching circuit 13 is configured for impedance matching of the first radiating portion E1.

The ground portion 14 is positioned in the housing 11. One end of the ground portion 14 is electrically connected to one end of the first radiating portion E1 adjacent to the groove 119. Another end of the ground portion 14 is electrically connected to the second ground point 233 for grounding the first radiating portion E1.

The first radiator 16 is positioned in the housing 11. The first radiator 16 is positioned at a spaced surrounded by the end portion 115, the first side portion 116, the first substrate 21, and the first electronic element 24. The first radiator 16 is spaced apart from the end portion 115. The first radiator 16 includes a ground section 161, a first radiating section 163, a second radiating section 165, and a third radiating section 167 connected in order.

The ground section 161 is substantially rectangular. The ground section 161 is positioned between the first electronic element 24 and the feed portion 12. One end of the ground section 161 is electrically connected to the first ground point 213. Another end of the ground section 161 extends along a direction parallel to the first side portion 116 towards the end portion 115.

The first radiating section 163, the second radiating section 165, and the third radiating section 167 are all positioned between the first electronic element 24 and the end portion 115. The first radiating section 163 is substantially rectangular. The first radiating section 163 is perpendicularly connected to one end of the ground section 161 away from the first ground point 213 and extends along a direction parallel to the end portion 115 towards the second side portion 117.

The second radiating section 165 is substantially rectangular. The second radiating section 165 is perpendicularly connected to one end of the first radiating section 163 away from the ground section 161 and extends along a direction parallel to the ground section 161 towards the end portion 115.

The third radiating section 167 is substantially rectangular. The third radiating section 167 is perpendicularly connected to one end of the second radiating section 165 away from the first radiating section 163 and extends along a direction parallel to the first radiating section 163 towards the first side portion 116.

In this embodiment, the first radiating section 163 and the third radiating section 167 are positioned at two ends of the second radiating section 165. The first radiating section 163, the second radiating section 165, and the third radiating section 167 cooperatively form a U-shaped structure. The first radiating section 163 is longer than the third radiating section 167. The third radiating section 167 is longer than the second radiating section 165.

The second radiator 17 is positioned in the housing 11. The second radiator 17 is positioned in a space surrounded by the end portion 115, the second side portion 117, and the second electronic element 25. The second radiator 17 is spaced apart from the end portion 115. The second radiator 17 includes a feed section 171, a first connecting section 173, a second connecting section 175, and a third connecting section 177 connected in order.

In this embodiment, the feed section 171 is substantially rectangular. One end of the feed section 171 is electrically connected to the second feed point 231 through a matching circuit 18 for feeding current to the second radiator 17. Another end of the feed section 171 extends along a direction parallel to the second side portion 117 towards the end portion 115. In this embodiment, the matching circuit 18 may be a capacitor, an inductor, or a combination. The matching circuit 18 is configured for impedance matching of the second radiator 17.

The first connecting section 173 is substantially rectangular. One end of the first connecting section 173 is perpendicularly connected to one end of the feed section 171 away from the second feed point 231. Another end of the first connecting section 173 extends along a direction parallel to the end portion 115 towards the second side portion 117.

One end of the second connecting section 175 is perpendicularly connected to one end of the first connecting section 173 away from the feed section 171. Another end of the second connecting section 175 extends along a direction parallel to the feed section 171 towards the second electronic element 25 (that is, away from the end portion 115). The third connecting section 177 is substantially rectangular. The third connecting section 177 is perpendicularly connected to an end of the second connecting section 175 away from the first connecting section 173 and extends along a direction parallel to the first connecting section 173 towards the feed section 171.

In this embodiment, the first connecting section 173 and the third connecting section 177 are positioned at two ends of the second r connecting section 175. The first connecting section 173, the second connecting section 175, and the third connecting section 177 cooperatively form a U-shaped structure. The first connecting section 173 is longer than the third connecting section 177. The third connecting section 177 is longer than the second connecting section 175.

Figure 3:
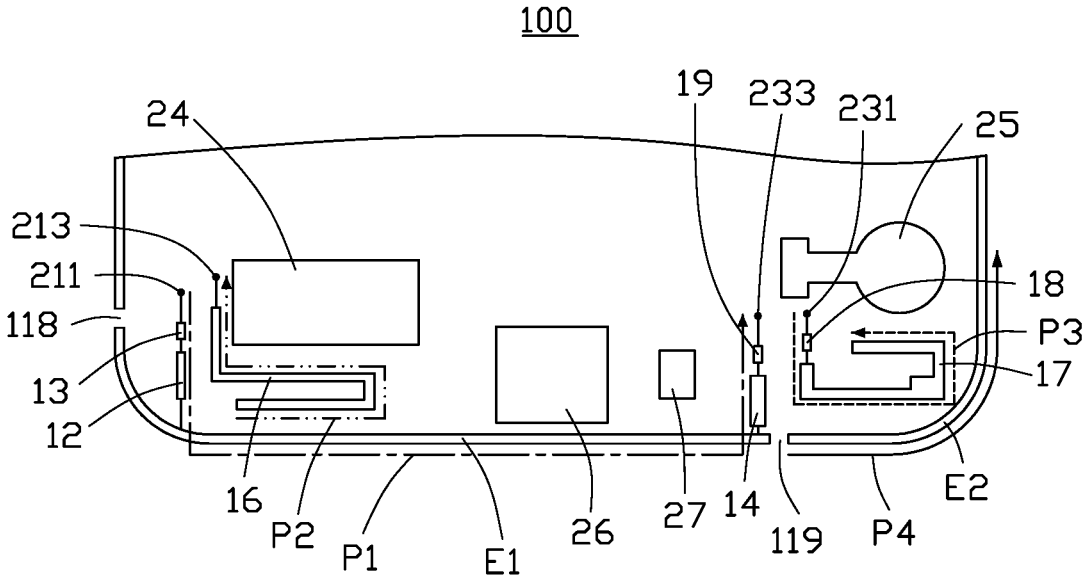
FIG. 3 is a current path distribution graph of the antenna structure of FIG. 2.

As illustrated in FIG. 3, when the feed portion 12 feeds current, the current flows through the first radiating portion E1, then flows towards the groove 119, and is grounded through the ground portion 14 and the second ground point 232 (Per path P1). The feed portion 12, the first radiating portion E1, and the ground portion 14 cooperatively form a loop antenna to activate a first operating mode to generate radiation signals in a first radiation frequency band.

In addition, when the feed portion 12 feeds current, the current flows through the first radiating portion E1, is coupled to the first radiator 16 through the first radiating portion E1, and is further grounded through the first ground point 213 (Per path P2). The radiator 16 is spaced apart from the first radiating portion E1. The first radiator 16 activates a second operating mode to generate radiation signals in a second radiation frequency band.

When the second feed point 231 feeds current, the current flows through the second radiator 17 (Per path P3). The second feed point 231 and the second radiator 17 cooperatively form a monopole antenna to activate a third operating mode to generate radiation signals in a third radiation frequency band.

In addition, when the second feed point 231 feeds current, the current flows through the second radiator 17, and is coupled to the second radiating portion E2 through the second radiator 17 (Per path P4). The second radiating portion E2 is spaced apart from the second radiator 17. The second radiator 17 activates a fourth operating mode to generate radiation signals in a fourth radiation frequency band.

In this embodiment, the first operating mode is a LTE-A low frequency operating mode. The second operating mode is a LTE-A Band 21 operating mode. The third operating mode is a LTE-A high frequency operating mode. The fourth operating mode is a LTE-A middle frequency operating mode. A frequency of the second radiation frequency band is higher than a frequency of the first radiation frequency band. A frequency of the third radiation frequency band is higher than a frequency of the fourth radiation frequency band. A frequency of the fourth radiation frequency band is higher than a frequency of the second radiation frequency band.

In this embodiment, the first radiation frequency band is about LTE-A 703-960 MHz. The second radiation frequency band is about LTE-A 1400-1700 MHz. The third radiation frequency band is about LTE-A 2300-2700 MHz. The fourth radiation frequency band is about LTE-A 1700-2200 MHz.

In other embodiments, the antenna structure 100 further includes a switching circuit 19. One end of the switching circuit 19 is electrically connected to the ground portion 14. Then, the switching circuit 19 is electrically connected to the first radiating portion E1 through the ground portion 14. Another end of the switching circuit 19 is grounded. The switching circuit 19 is configured for effectively adjusting the first radiation frequency band, that is, the low frequency band of the antenna structure 100.

Figure 4:
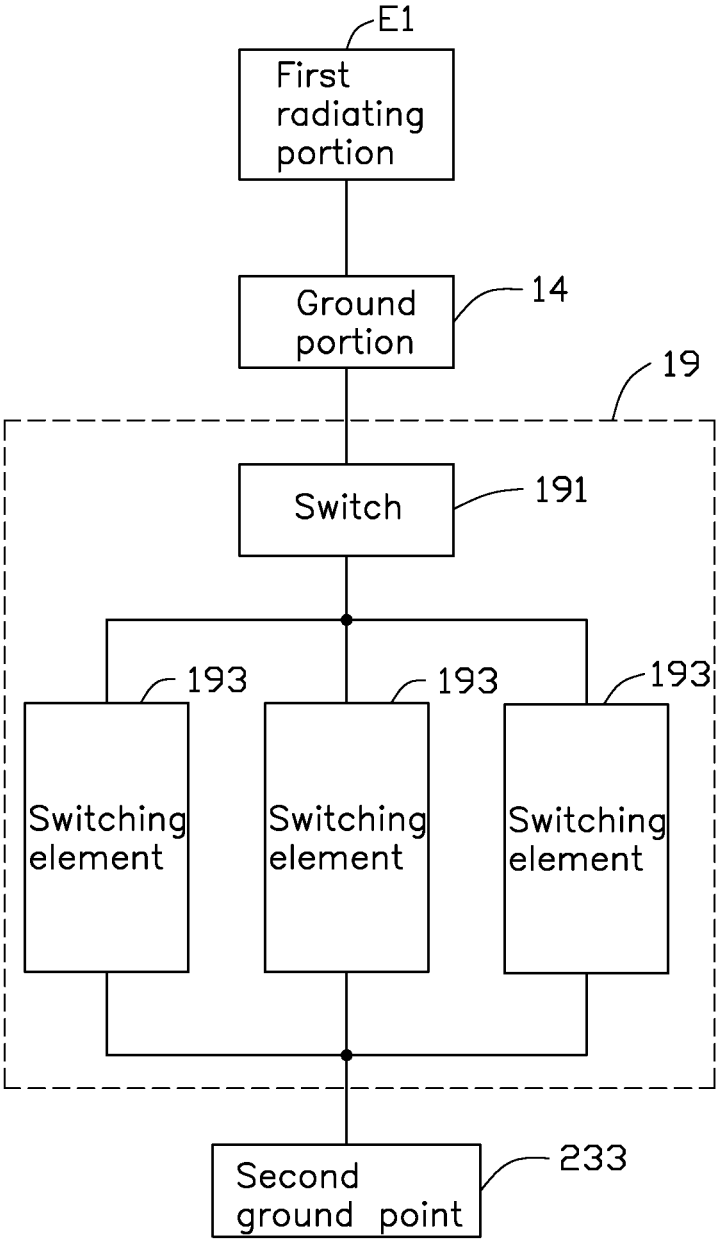
FIG. 4 is a circuit diagram of a switching circuit of the antenna structure of FIG. 1.

As illustrated in FIG. 4, in this embodiment, the switching circuit 19 includes a switch 191 and a plurality of switching elements 193. The switch 191 is electrically connected to the ground portion 14. Then, the switch 191 is electrically connected to the first radiating portion E1 through the ground portion 14. The switching elements 193 can be an inductor, a capacitor, or a combination of the inductor and the capacitor. The switching elements 193 are connected in parallel to each other. One end of each switching element 193 is electrically connected to the switch 191. The other end of each switching element 193 is grounded.

Through control of the switch 191, the first radiating portion E1 can be switched to connect with different switching elements 193. Since each switching element 193 has a different impedance, the low frequency band of the antenna structure 100, that is, the first radiation frequency band, can be effectively adjusted.

Figure 5:
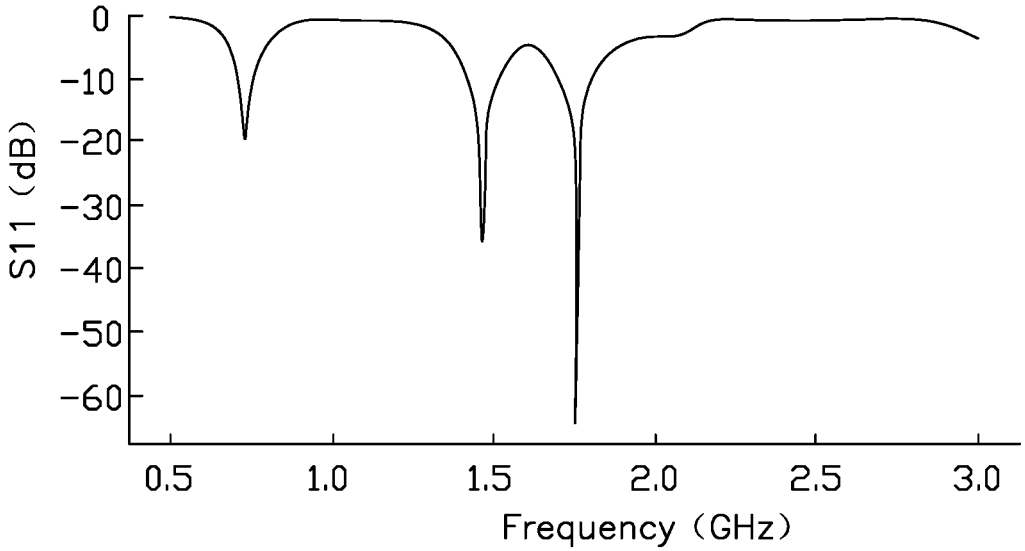
FIG. 5 is a scattering parameter graph when the antenna structure of FIG. 1 works at a first radiation frequency band and a second radiation frequency band.

FIG. 5 illustrates a scattering parameter graph when the antenna structure 100 works at the first and second radiation frequency bands (that is, the LTE-A low frequency band and the frequency band of LTE-A Band 21).

Figure 6:
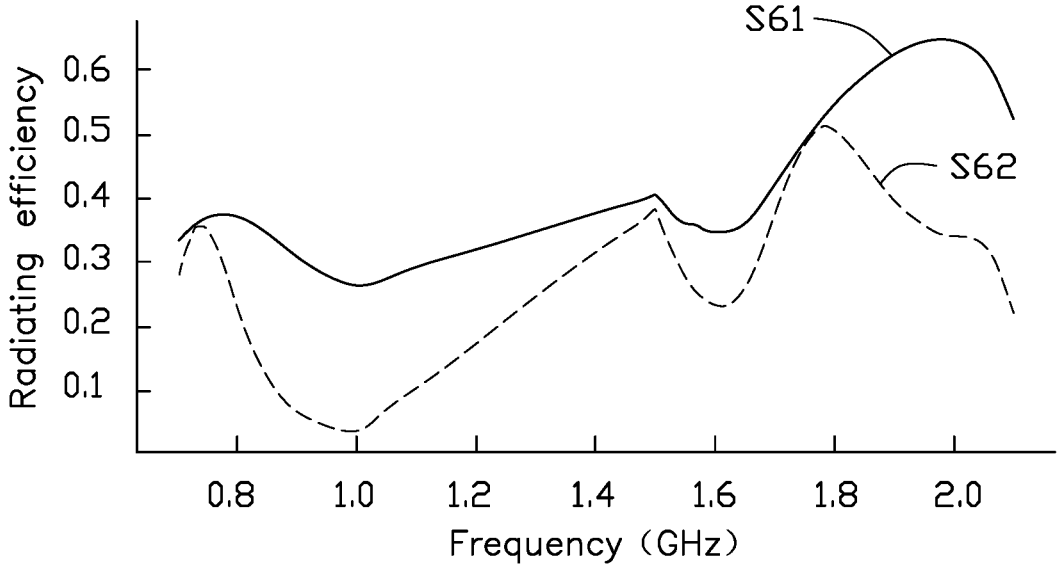
FIG. 6 is a radiating efficiency graph when the antenna structure of FIG. 1 works at the first radiation frequency band and the second radiation frequency band.

FIG. 6 illustrates a radiating efficiency graph when the antenna structure 100 works at the first and second radiation frequency bands (that is, the LTE-A low frequency band and the frequency band of LTE-A Band 21). Curve S61 illustrates a radiating efficiency when the antenna structure 100 works at the first and second radiation frequency bands. Curve S62 illustrates a total radiating efficiency when the antenna structure 100 works at the first and second radiation frequency bands.

In views of curves S61 and S62, when the antenna structure 100 works at the LTE-A low frequency band, a radiating efficiency of the antenna structure 100 is about 30%. When the antenna structure 100 works at the frequency band of LTE-A Band 21, a radiating efficiency of the antenna structure 100 is about 38%.

Figure 7:
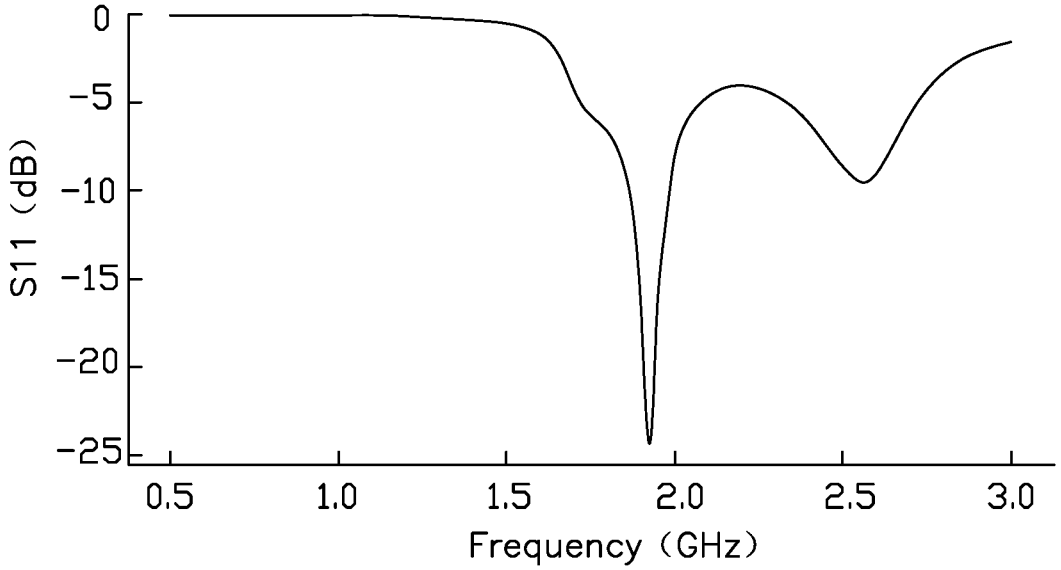
FIG. 7 is a scattering parameter graph when the antenna structure of FIG. 1 works at a third radiation frequency band and a fourth radiation frequency band.

FIG. 7 illustrates a scattering parameter graph when the antenna structure 100 works at the third and fourth radiation frequency bands (that is, the LTE-A middle and high frequency bands).

Figure 8:
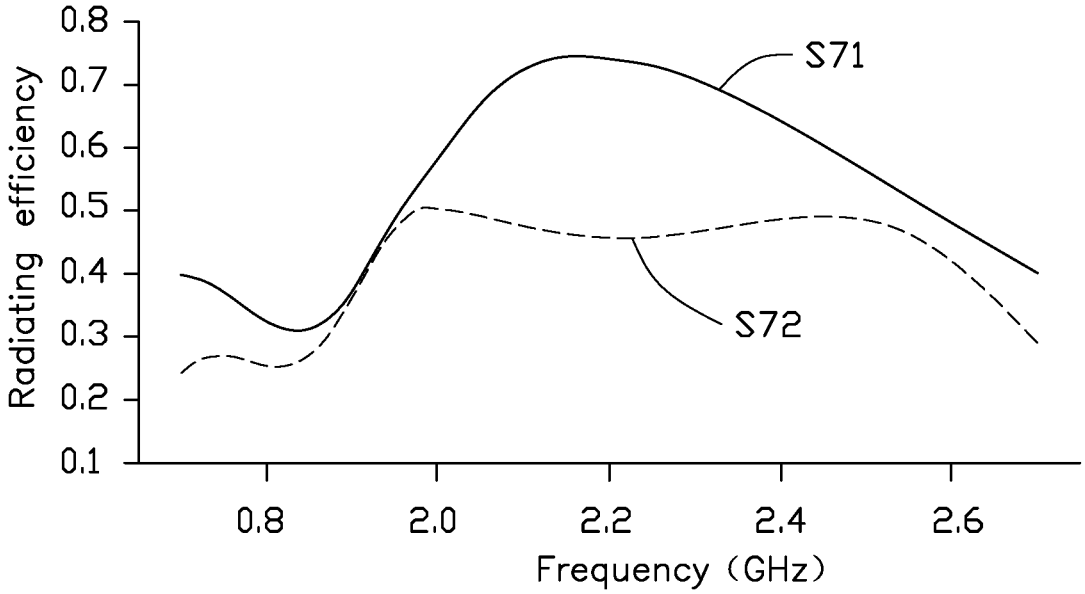
FIG. 8 is a radiating efficiency graph when the antenna structure of FIG. 1 works at the third radiation frequency band and the fourth radiation frequency band.

FIG. 8 illustrates a radiating efficiency graph when the antenna structure 100 works at the third and fourth radiation frequency bands (that is, the LTE-A middle and high frequency bands). Curve S81 illustrates a radiating efficiency when the antenna structure 100 works at the third and fourth radiation frequency bands. Curve S82 illustrates a total radiating efficiency when the antenna structure 100 works at the third and fourth radiation frequency bands.

In views of curves S81 and S82, when the antenna structure 100 works at the LTE-A middle frequency band, a radiating efficiency of the antenna structure 100 is about 50%. When the antenna structure 100 works at the LTE-A high frequency band, a radiating efficiency of the antenna structure 100 is about 40%.

As illustrated in FIG. 5 to FIG. 8, a working frequency of the antenna structure 100 can cover 703-960 MHz, 1400-1700 MHz, and 1710-2690 MHz. That is, the antenna structure 100 may work at corresponding low, middle, and high frequency bands, and a frequency band of LTE-A Band 21. When the antenna structure 100 works at these frequency bands, the antenna structure 100 has a good radiating efficiency, which satisfies antenna design requirements.

In other embodiments, locations of the feed portion 12 and the ground portion 14 can be exchanged. Then, a location of the first feed point 211 on the first substrate 21 and a location of the second ground point 233 on the second substrate 23 can be exchanged. That is, one end of the feed portion 12 is electrically connected to the first feed point 211 on the second substrate 23 through the matching circuit 13. Another end of the feed portion 12 is electrically connected to an end of the first radiation portion E1 adjacent to the groove 119. One end of the ground portion 14 is electrically connected to the second ground point 233 on the first substrate 21 through the switching circuit 19. Another end of the ground portion 14 is electrically connected to an end of the first radiating portion E1 adjacent to the gap 118.

As described above, the antenna structure 100 defines the gap 118 and the groove 119, then the side frame 112 is divided into a first radiating portion E1 and a second radiating portion E2. The antenna structure 100 further includes the feed portion 12, the ground portion 14, and the second radiator 17. The current from the feed portion 12 flows through the first radiating portion E1 and is further grounded through the ground portion 14 to activate the first operating mode to generate radiation signals in the LTE-A low frequency band. The second radiator 17 also feeds current, the current from the second radiator 17 is further grounded to activate the third operating mode to generate radiation signals in the LTE-A high frequency band. In addition, the current from the second radiator 17 is further coupled to the second radiating portion E2, then the second radiating portion E2 generates radiation signals in the LTE-A middle frequency band. The wireless communication device 200 can use carrier aggregation (CA) technology of LTE-A to receive or send wireless signals at multiple frequency bands simultaneously.

In addition, the antenna structure 100 includes the first radiator 16. The current flowing through the first radiating portion E1 is further coupled to the first radiator 16. The first radiator 16 then can work at a frequency bang of LTE-A Band 21. That is, the antenna structure 100 can be fully applied to the frequency bands of GSM Qual-band, UMTS Band I/II/V/VIII, and LTE 700/850/900/1800/1900/2100/2300/2500. The antenna structure 100 also has a 3CA function and a LTE-A Band 21 characteristic.

The embodiments shown and described above are only examples. Many details are often found in the art such as the other features of the antenna structure and the wireless communication device. Therefore, many such details are neither shown nor described. Even though numerous characteristics and advantages of the present disclosure have been set forth in the foregoing description, together with details of the structure and function of the present disclosure, the disclosure is illustrative only, and changes may be made in the details, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An antenna structure comprising: a housing, the housing comprising a first radiating portion and a second radiating portion spaced apart from the first radiating portion; a feed portion, the feed portion electrically connected to the first radiating portion for feeding current to the first radiating portion; a ground portion, the ground portion electrically connected to the first radiating portion for grounding the first radiating portion; a first radiator, the first radiator positioned in the housing; and a second radiator, the second radiator positioned in the housing and spaced apart from the first radiator; wherein when the feed portion feeds current, the current flows through the first radiating portion and is grounded through the ground portion to activate a first operating mode to generate radiation signals in a first radiation frequency band, when the feed portion feeds current, the current is further coupled to the first radiator through the first radiating portion, and the first radiator activates a second operating mode to generate radiation signals in a second radiation frequency band;

wherein when a feed point feeds current to the second radiator, the second radiator activates a third operating mode to generate radiation signals in a third radiation frequency band;

wherein when the feed point feeds current to the second radiator, the current is further coupled to the second radiating portion through the second radiator, and the second radiating portion activates a fourth operating mode to generate radiation signals in a fourth radiation frequency band.

2. The antenna structure of claim 1, wherein a frequency of the second radiation frequency band is higher than a frequency of the first radiation frequency band, a frequency of the third radiation frequency band is higher than a frequency of the fourth radiation frequency band, and a frequency of the fourth radiation frequency band is higher than a frequency of the second radiation frequency band.

3. The antenna structure of claim 2, wherein the first operating mode is a LTE-A low frequency operating mode, the second operating mode is a LTE-A Band 21 operating mode, the third operating mode is a LTE-A high frequency operating mode, and the fourth operating mode is a LTE-A middle frequency operating mode.

4. The antenna structure of claim 1, wherein the housing comprises a side frame, the side frame comprises an end portion, a first side portion, and a second side portion, the first side portion and the second side portion are respectively connected to two ends of the end portion; wherein the housing further defines a gap and a groove, the gap and the groove both pass through and extend to cut across the housing; and wherein the housing is divided into the first radiating portion and the second radiating portion by the gap and the groove; wherein a portion of the side frame between the gap and the groove forms the first radiating portion, a portion of the side frame extending from a side of the groove away from the first radiating portion and the gap forms the second radiating portion.

5. The antenna structure of claim 4, wherein the first radiator comprises a ground section, a first radiating section, a second radiating section, and a third radiating section connected in order; wherein one end of the ground section is grounded, another end of the ground section extends along a direction parallel to the first side portion towards the end portion; wherein the first radiating section is perpendicularly connected to one end of the ground section and extends along a direction parallel to the end portion towards the second side portion; wherein the second radiating section is perpendicularly connected to one end of the first radiating section away from the ground section and extends along a direction parallel to the ground section towards the end portion; and wherein the third radiating section is perpendicularly connected to one end of the second radiating section away from the first radiating section and extends along a direction parallel to the first radiating section towards the first side portion.

6. The antenna structure of claim 4, wherein the second radiator comprises a feed section, a first connecting section, a second connecting section, and a third connecting section connected in order; wherein one end of the feed section is electrically connected to the feed point for feeding current to the second radiator, another end of the feed section extends along a direction parallel to the second side portion towards the end portion; wherein the first connecting section is perpendicularly connected to one end of the feed section and extends along a direction parallel to the end portion towards the second side portion; wherein the second connecting section is perpendicularly connected to one end of the first connecting section away from the feed section and extends along a direction parallel to the feed section away from the end portion; and wherein the third connecting section is perpendicularly connected to an end of the second connecting section away from the first connecting section and extends along a direction parallel to the first connecting section towards the feed section.

7. The antenna structure of claim 4, wherein the gap and the groove are both filled with insulating material.

8. The antenna structure of claim 1, wherein a wireless communication device uses the first radiating portion, the second radiating portion, and the second radiator to receive or send wireless signals at multiple frequency bands simultaneously through carrier aggregation (CA) technology of Long Term Evolution Advanced (LTE-A).

9. A wireless communication device comprising: an antenna structure, the antenna structure comprising: a housing, the housing comprising a first radiating portion and a second radiating portion spaced apart from the first radiating portion; a feed portion, the feed portion electrically connected to the first radiating portion for feeding current to the first radiating portion; a ground portion, the ground portion electrically connected to the first radiating portion for grounding the first radiating portion; a first radiator, the first radiator positioned in the housing; and a second radiator, the second radiator positioned in the housing and spaced apart from the first radiator; wherein when the feed portion feeds current, the current flows through the first radiating portion and is grounded through the ground portion to activate a first operating mode to generate radiation signals in a first radiation frequency band, when the feed portion feeds current, the current is further coupled to the first radiator through the first radiating portion, and the first radiator activates a second operating mode to generate radiation signals in a second radiation frequency band; wherein when a feed point feeds current to the second radiator, the second radiator activates a third operating mode to generate radiation signals in a third radiation frequency band; wherein when the feed point feeds current to the second radiator, the current is further coupled to the second radiating portion through the second radiator, and the second radiating portion activates a fourth operating mode to generate radiation signals in a fourth radiation frequency band.

10. The wireless communication device of claim 9, further comprising a first substrate, a second substrate, a speaker, a vibrator, a Universal Serial Bus (USB) module, and a microphone; wherein the first substrate and the second substrate are both positioned in the housing, the first substrate is spaced apart from the second substrate; wherein the speaker is positioned between the first substrate and the second substrate, the vibrator is positioned one side of the second substrate away from the first substrate; wherein the USB module and the microphone are positioned on the second substrate; wherein the first radiator is positioned at a space surrounded by the first substrate, the speaker, and the housing; and wherein the second radiator is positioned at a space surrounded by the housing, the vibrator, and the microphone.

11. The wireless communication device of claim 9, wherein a frequency of the second radiation frequency band is higher than a frequency of the first radiation frequency band, a frequency of the third radiation frequency band is higher than a frequency of the fourth radiation frequency band, and a frequency of the fourth radiation frequency band is higher than a frequency of the second radiation frequency band.

12. The wireless communication device of claim 11, wherein the first operating mode is a LTE-A low frequency operating mode, the second operating mode is a LTE-A Band 21 operating mode, the third operating mode is a LTE-A high frequency operating mode, and the fourth operating mode is a LTE-A middle frequency operating mode.

13. The wireless communication device of claim 9, wherein the housing comprises a side frame, the side frame comprises an end portion, a first side portion, and a second side portion, the first side portion and the second side portion are respectively connected to two ends of the end portion; wherein the housing further defines a gap and a groove, the gap and the groove both pass through and extend to cut across the housing; and wherein the housing is divided into the first radiating portion and the second radiating portion by the gap and the groove; wherein a portion of the side frame between the gap and the groove forms the first radiating portion, a portion of the side frame extending from a side of the groove away from the first radiating portion and the gap forms the second radiating portion.

14. The wireless communication device of claim 13, wherein the first radiator comprises a ground section, a first radiating section, a second radiating section, and a third radiating section connected in order; wherein one end of the ground section is grounded, another end of the ground section extends along a direction parallel to the first side portion towards the end portion; wherein the first radiating section is perpendicularly connected to one end of the ground section and extends along a direction parallel to the end portion towards the second side portion; wherein the second radiating section is perpendicularly connected to one end of the first radiating section away from the ground section and extends along a direction parallel to the ground section towards the end portion; and wherein the third radiating section is perpendicularly connected to one end of the second radiating section away from the first radiating section and extends along a direction parallel to the first radiating section towards the first side portion.

15. The wireless communication device of claim 13, wherein the second radiator comprises a feed section, a first connecting section, a second connecting section, and a third connecting section connected in order; wherein one end of the feed section is electrically connected to athe feed point for feeding current to the second radiator, another end of the feed section extends along a direction parallel to the second side portion towards the end portion; wherein the first connecting section is perpendicularly connected to one end of the feed section and extends along a direction parallel to the end portion towards the second side portion; wherein the second connecting section is perpendicularly connected to one end of the first connecting section away from the feed section and extends along a direction parallel to the feed section away from the end portion; and wherein the third connecting section is perpendicularly connected to an end of the second connecting section away from the first connecting section and extends along a direction parallel to the first connecting section towards the feed section.

16. The wireless communication device of claim 13, wherein the gap and the groove are both filled with insulating material.

17. The wireless communication device of claim 9, wherein the wireless communication device uses the first radiating portion, the second radiating portion, and the second radiator to receive or send wireless signals at multiple frequency bands simultaneously through carrier aggregation (CA) technology of Long Term Evolution Advanced (LTE-A).

* * * * *